US008274451B2

(12) United States Patent
Kim et al.

(10) Patent No.: US 8,274,451 B2
(45) Date of Patent: Sep. 25, 2012

(54) ELECTROLUMINESCENT DEVICE AND METHOD OF DRIVING THE SAME

(75) Inventors: Ji Hun Kim, Seoul (KR); Hee Young Lee, Daegu (KR); Jae Do Lee, Gumi-shi (KR)

(73) Assignee: LG Display Co., Ltd., Seoul (KR)

( * ) Notice: Subject to any disclaimer, the term of this patent is extended or adjusted under 35 U.S.C. 154(b) by 1104 days.

(21) Appl. No.: 11/300,424

(22) Filed: Dec. 15, 2005

(65) Prior Publication Data

US 2006/0132056 A1 Jun. 22, 2006

(30) Foreign Application Priority Data

Dec. 16, 2004 (KR) ..... 10-2004-0107423
Dec. 2, 2005 (KR) ..... 10-2005-0116997

(51) Int. Cl.
*G09G 3/30* (2006.01)

(52) U.S. Cl. ..... 345/76; 315/169.3

(58) Field of Classification Search ..... 345/76–84; 315/169.3

See application file for complete search history.

(56) References Cited

U.S. PATENT DOCUMENTS 6,534,925 B2 * 3/2003 Kawashima ..... 315/169.1
6,650,308 B2 * 11/2003 Kawashima ..... 345/76
6,836,265 B1 * 12/2004 Lee et al. ..... 345/87
6,963,172 B2 * 11/2005 Maede et al. ..... 315/169.1
6,989,826 B2 * 1/2006 Kasai ..... 345/204
7,106,281 B2 * 9/2006 Kim et al. ..... 345/76
7,119,769 B2 * 10/2006 Abe et al. ..... 345/76
7,183,719 B2 * 2/2007 Yang ..... 315/169.4
7,400,098 B2 * 7/2008 Ng et al. ..... 315/169.3
7,714,815 B2 * 5/2010 Kim et al. ..... 345/82
7,773,084 B2 * 8/2010 Itakura et al. ..... 345/215
2003/0038760 A1 * 2/2003 Kim et al. ..... 345/76
2003/0059525 A1 * 3/2003 Moon ..... 427/66
2003/0234761 A1 * 12/2003 Washio et al. ..... 345/100
2004/0145556 A1 * 7/2004 Nakanishi ..... 345/99
2005/0001795 A1 * 1/2005 Kitahara ..... 345/76
2005/0093788 A1 * 5/2005 Shin ..... 345/76
2005/0270258 A1 * 12/2005 Shin ..... 345/76
2006/0139262 A1 * 6/2006 Lee ..... 345/76
2007/0057628 A1 * 3/2007 Kim ..... 313/504
2007/0057875 A1 * 3/2007 Kwon ..... 345/76
2007/0139308 A1 * 6/2007 Kim et al. ..... 345/76

* cited by examiner

*Primary Examiner* — Jason Mandeville
(74) *Attorney, Agent, or Firm* — Morgan, Lewis & Bockius LLP

(57) ABSTRACT

The present invention relates to an electroluminescent device, particularly to an organic electroluminescent device reliably receiving driving voltage from a voltage source, and a method of driving the same. A driving circuit of the electroluminescent device includes first to third sub-pixels formed on crossing areas of data lines and scan lines, a pre-charge driving circuit which applies pre-charge current to the data lines of the first to third sub-pixels and a data driving circuit which applies data current to the pre-charged data lines. The pre-charge current is applied to the first to third sub-pixels in different time. The organic electroluminescent device of the present invention and the method of driving the same can reliably receive the driving voltage from the voltage source, and prevent quick flames of the device.

16 Claims, 9 Drawing Sheets

ELECTROLUMINESCENT DEVICE AND METHOD OF DRIVING THE SAME

BACKGROUND OF THE INVENTION

1. Field of the Invention

The present invention relates to an electroluminescent device, particularly to an organic electroluminescent device reliably receiving driving voltage from a voltage source, and a method of driving the same.

2. Description of the Related Art

Recently, there have been active efforts to develop various display devices in which the cumbersome weight and volume of the cathode ray tube are reduced. Liquid crystal display (LCD), field emission display (FED), plasma display panel (PDP), and electroluminescent device (EL) are the kinds of display device.

PDP is most advantageous to large screen because the structure and manufacturing method are relatively simple. However, PDP has disadvantages that the emitting efficiency and brightness are low, and the consumption power is high.

The demand of LCD has been increased, as LCD is mainly used in the display device of laptop computer. However, LCD is difficult to use for large screen because it is manufactured in semiconductor process. Also, LCD is not self-emitting device, and thus needs extra light source. Due to the light source, LCD's consumption power is disadvantageously high. Moreover, LCD loses much light for optical devices, for example, polarizing filter, prism sheet, diffusion sheet, etc., and has another shortcoming that the angle of vision is narrow.

EL is classified into inorganic electroluminescent device and organic electroluminescent device. EL has advantages such as high speed, good emitting efficiency, high brightness, and wide angle of vision. Organic electroluminescent device can display the picture with tens of thousands of high brightness [cd/m$^2$] at about 10V of voltage, and is applied to most commercial EL.

FIG. 1 is a diagram of a related-art organic electroluminescent device. FIG. 2 is a timing diagram showing scan line signals and data current applied to the organic electroluminescent device of FIG. 1. FIG. 3 is a timing diagram showing delay of replying time of a related-art organic electroluminescent device. FIG. 4 is a diagram showing a data pulse applied to a related-art organic electroluminescent device. And, FIG. 5 is a diagram showing drop of driving voltage according to a pre-charge current of FIG. 4.

In FIG. 1 and FIG. 2, the organic electroluminescent device includes a panel 20, a scan driving circuit 24, and a data driving circuit 22.

The panel 20 includes a plurality of pixels 10 formed on an area crossing over data lines (from DL1 to DLm) and scan lines (from SL1 to SLn).

The scan driving circuit 24 applies scan signals (SCAN) to the scan lines (from SL1 to SLn). The data driving circuit 22 applies data current (Id) to the data lines (from DL1 to DLm).

Each pixel 10 includes a red sub-pixel 10A, a green sub-pixel 10B, and a blue sub-pixel 10*c*.

The anode of the red, green and blue sub-pixels 10A, 10B and 10C is connected to the data lines (from DL1 to DLm), and the cathode is connected to the scan lines (from SL1 to SLn). The red, green, and blue sub-pixels 10A, 10B and 10C emit light during low logic time of the scan signal (SCAN) applied to the scan lines (from SL1 to SLn) when the data current (Id) is applied to the data lines (from DL1 to DLm) as shown in FIG. 2.

That is, when the data current (Id) is applied to the red, green and blue sub-pixels 10A, 10B and 10C, the organic electroluminescent device realizes colored picture to one pixel 10 by combination of the red, green and blue sub-pixels 10A, 10B and 10C through emitting in brightness proportional to the current applied to the red, green and blue sub-pixels 10A, 10B and 10C.

However, real data current (Id) applied to the pixels 10 is smaller than the current applied from the data driving circuit 22 by resistance of the data lines (from DL1 to DLm) and capacitance of the pixels 10 as shown in FIG. 3. Also, the organic electroluminescent device has low brightness and long responsive time (RT) because emitting is delayed as much as the period of time that current is charged to the pixels 10.

Thus, as shown in FIG. 4, a pre-charge current (Ipd) is also applied to the organic electroluminescent device, besides the data current (Id). The pre-charge current (Ipd) is applied to the red, green and blue sub-pixels 10A, 10B and 10C during a pre-charge time (PT) before the data current (Id) is applied to the pixels 10.

Generally, the pre-charge current (Ipd) is ten times as much as the data current (Id). Therefore, the driving circuit of the organic electroluminescent device has to apply a lot of current to the pixels during the pre-charge time (PT).

If too high pre-charge current (Ipd) is applied to the pixels 10, the driving circuit of the organic electroluminescent device cuts off the driving voltage (V) applied from a voltage source (not shown).

In detail, the driving circuit drives the organic electroluminescent device below a prescribed current by receiving a prescribed driving voltage (V) from the voltage source. If high current like the pre-charge current (Ipd) is applied to the organic electroluminescent device at the same time, voltage drop (V_Drop) is occurred in the driving voltage (V) applied to the organic electroluminescent device, as shown in FIG. 5. And, the dropped voltage (V_Drop) is transmitted to a power driving circuit (not shown) which controls power of the organic electroluminescent device.

At this time, the power driving circuit recognizes the dropped voltage (V_Drop) as the driving voltage (V) applied from voltage source to the organic electroluminescent device. And, the power driving circuit compares the dropped voltage (V_Drop) with a critical value of the driving voltage (V) stored in memory (not shown). If the dropped voltage (V_Drop) is less than the critical value of the driving voltage (V), the power driving circuit cuts off the driving voltage (V) applied from the voltage source to the organic electroluminescent device because the power driving circuit recognizes that voltage of the voltage source for driving the organic electroluminescent device is short.

Therefore, the driving voltage (V) cannot be reliably applied to the organic electroluminescent device because of very high pre-charge current (Ipd) applied at once.

SUMMARY OF THE INVENTION

One object of the present invention is to solve at least one of the above problems and/or disadvantages and to provide at least one advantage described hereinafter.

Another object of the present invention is to provide an electroluminescent device which reliably receives the driving voltage from a voltage source, and a method for driving the same.

Another object of the present invention is to provide an electroluminescent device in which prevents quick flames of the driving devices, and a method for driving the same.

In accordance with a first embodiment of the present invention, the driving circuit of the electroluminescent device includes first to third sub-pixels formed on crossing areas of data lines and scan lines. This device also includes a pre-charge driving circuit which applies a pre-charge current to the data lines of the first to third sub-pixels, and a data driving circuit which applies a data current to the pre-charged data lines, wherein the pre-charge current is applied to the first to third sub-pixels in different time.

Additionally, the circuit further includes a discharge driving circuit which discharges the data lines charged by the data current.

The method for driving the electroluminescent device according to a second embodiment of the present invention includes a step of applying a pre-charge current to the data lines of the first to third sub-pixels in different time, applying a data current to the pre-charged data lines of the first to third sub-pixels, and discharging the pre-charge current and the data current applied to the first to third sub-pixels.

The electroluminescent device according to a third embodiment of the present invention includes a plurality of scan lines in a first direction, a plurality of data lines in a second direction different from the first direction, a plurality of first to third sub-pixels, each sub-pixel including a corresponding scan line and a corresponding data line, a pre-charge driving circuit which applies pre-charge current to the data lines of the first to third sub-pixels, a data driving circuit which applies data current to the pre-charged data lines, wherein the pre-charge current is applied to the first to third sub-pixels in different time, and a discharge driving circuit which discharges the data lines charged by the data current.

The driving method of the electroluminescent device according to a fourth embodiment of the present invention includes a step of applying first to third pre-charge waveforms to the data lines of the first to third sub-pixels, wherein the pre-charge waveform includes non-pre-charging period and pre-charging period, and wherein starting time of the pre-charge period of the first pre-charge waveform is different from that of the second pre-charge waveform.

As described above, the electroluminescent device of the present invention and the method for driving the same can decrease the pre-charge current applied from the voltage source since the pre-charge current is applied to the data lines of the red, green and blue sub-pixels in sequence. Thus, the driving voltage can be reliably applied from the voltage source to the electroluminescent device, thereby preventing quick flames of the device.

Also, the driving circuit of the electroluminescent device of the present invention can decrease load of the electroluminescent device to the current discharged from the pixels by discharging in sequence the data current and pre-charge current applied to the data lines of the red, green and blue sub-pixels.

BRIEF DESCRIPTION OF THE DRAWINGS

The invention will be described in detail with reference to the following drawings in which same reference numerals are used to refer to same elements wherein.

DESCRIPTION OF EMBODIMENTS

Hereinafter, preferred embodiments of the present invention will be explained in more detail with reference to the accompanying drawings.

Figure 1:
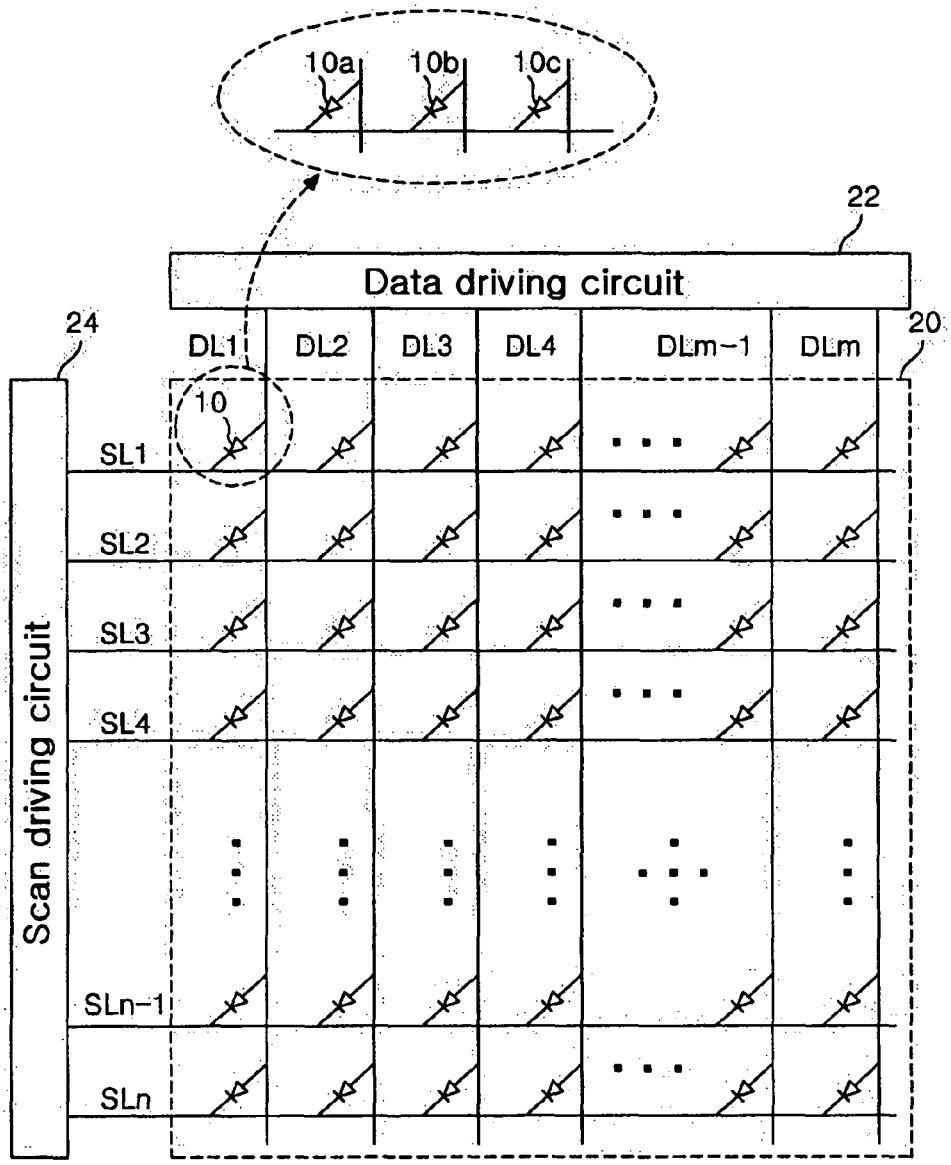
FIG. 1 [RELATED ART]
FIG. 1 is a diagram of a related-art organic electroluminescent device.
Figure 2:
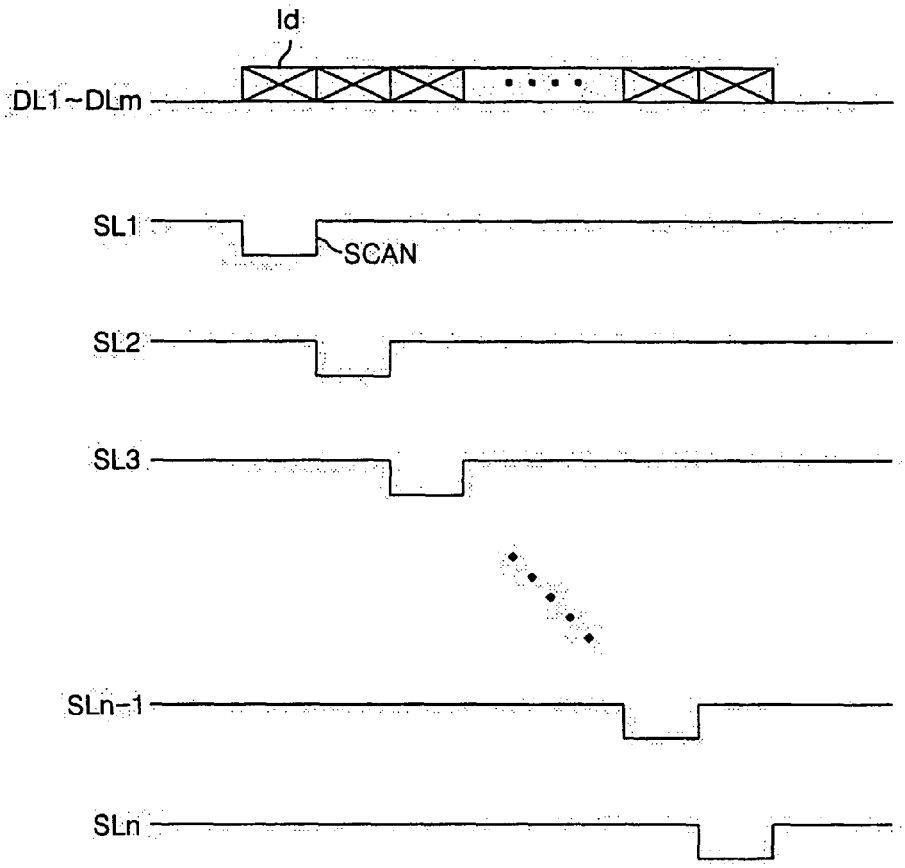
FIG. 2 [RELATED ART]
FIG. 2 is a timing diagram showing scan line signals and data current applied to the organic electroluminescent device of FIG. 1.
Figure 3:
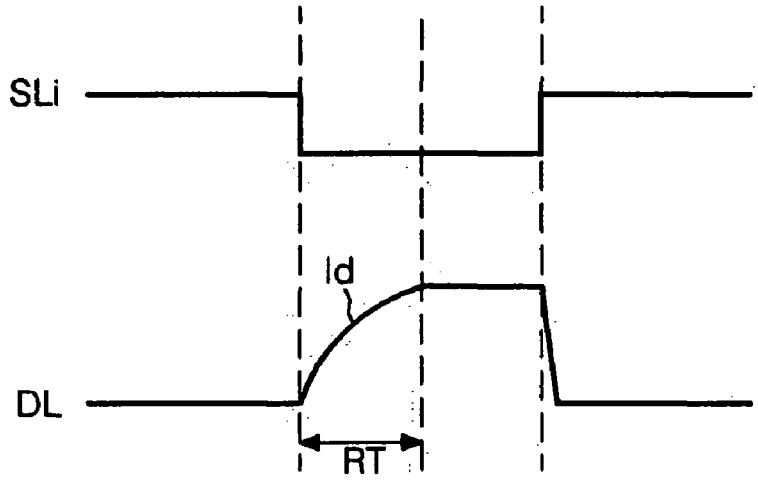
FIG. 3 [RELATED ART]
FIG. 3 is a timing diagram showing delay of replying time of a related-art organic electroluminescent device.
Figure 4:
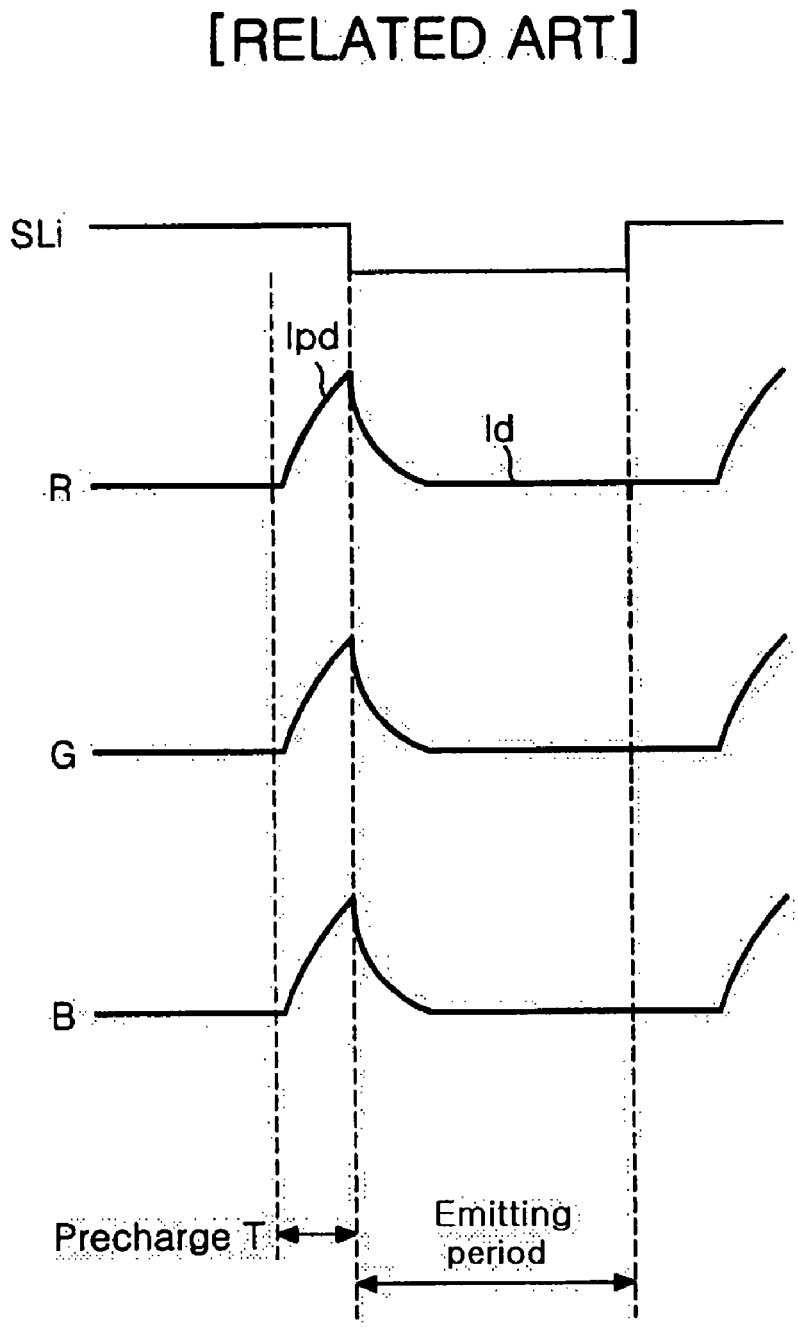
FIG. 4 is a diagram showing a data pulse applied to a related-art organic electroluminescent device.
Figure 5:
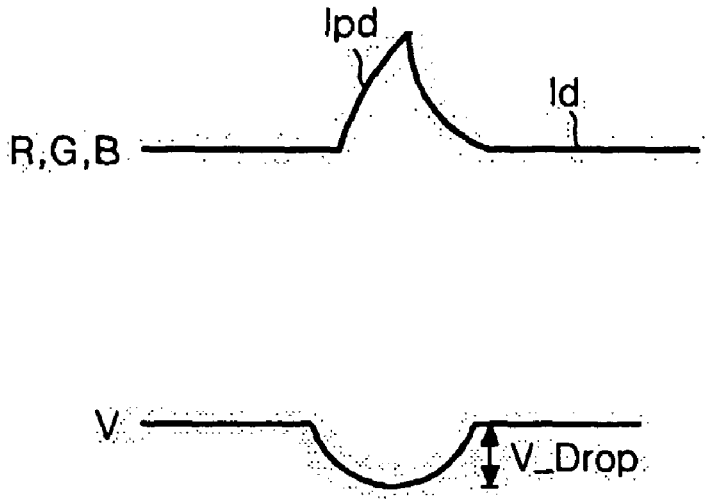
FIG. 5 [RELATED ART]
FIG. 5 is a diagram showing drop of driving voltage according to the pre-charge current of FIG. 4.
Figure 6:
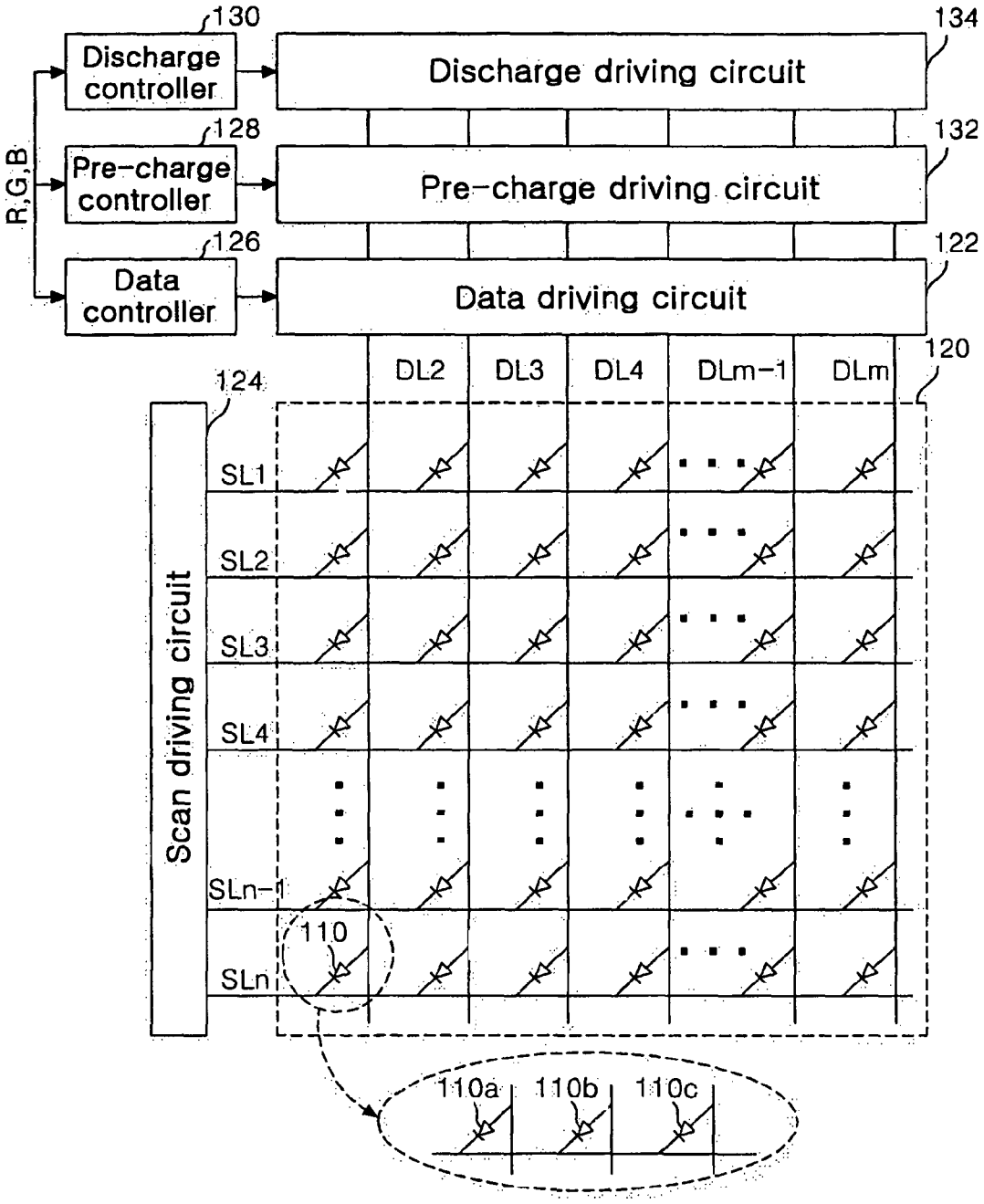
FIG. 6 is a diagram of the organic electroluminescent device according to one embodiment of the present invention.
Figure 7:
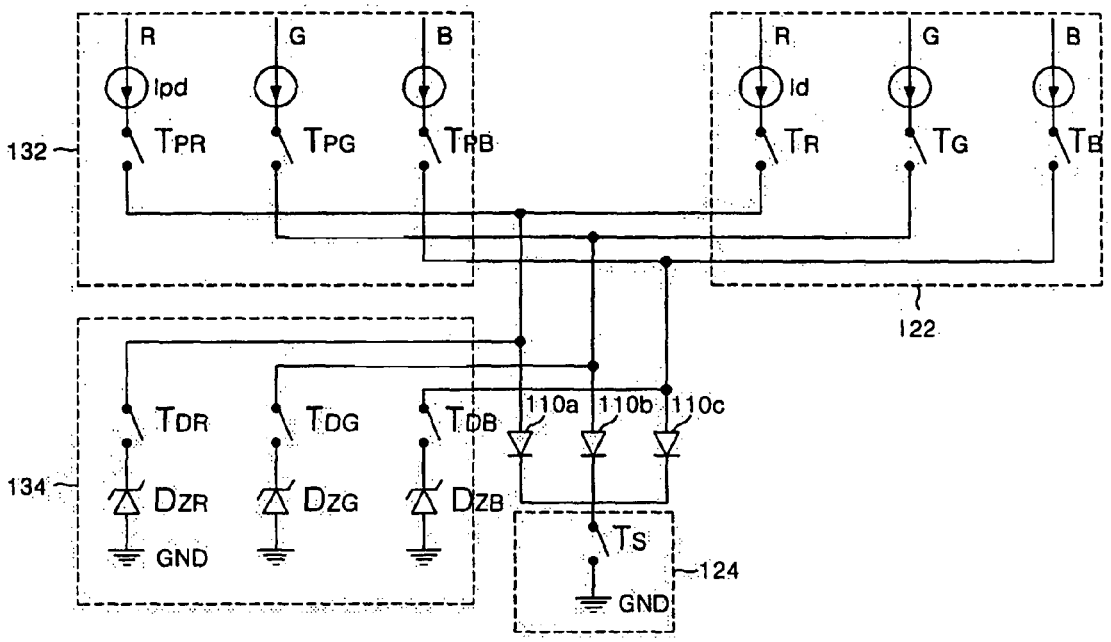
FIG. 7 is a driving circuit of the organic electroluminescent device of FIG. 6.
Figure 8:
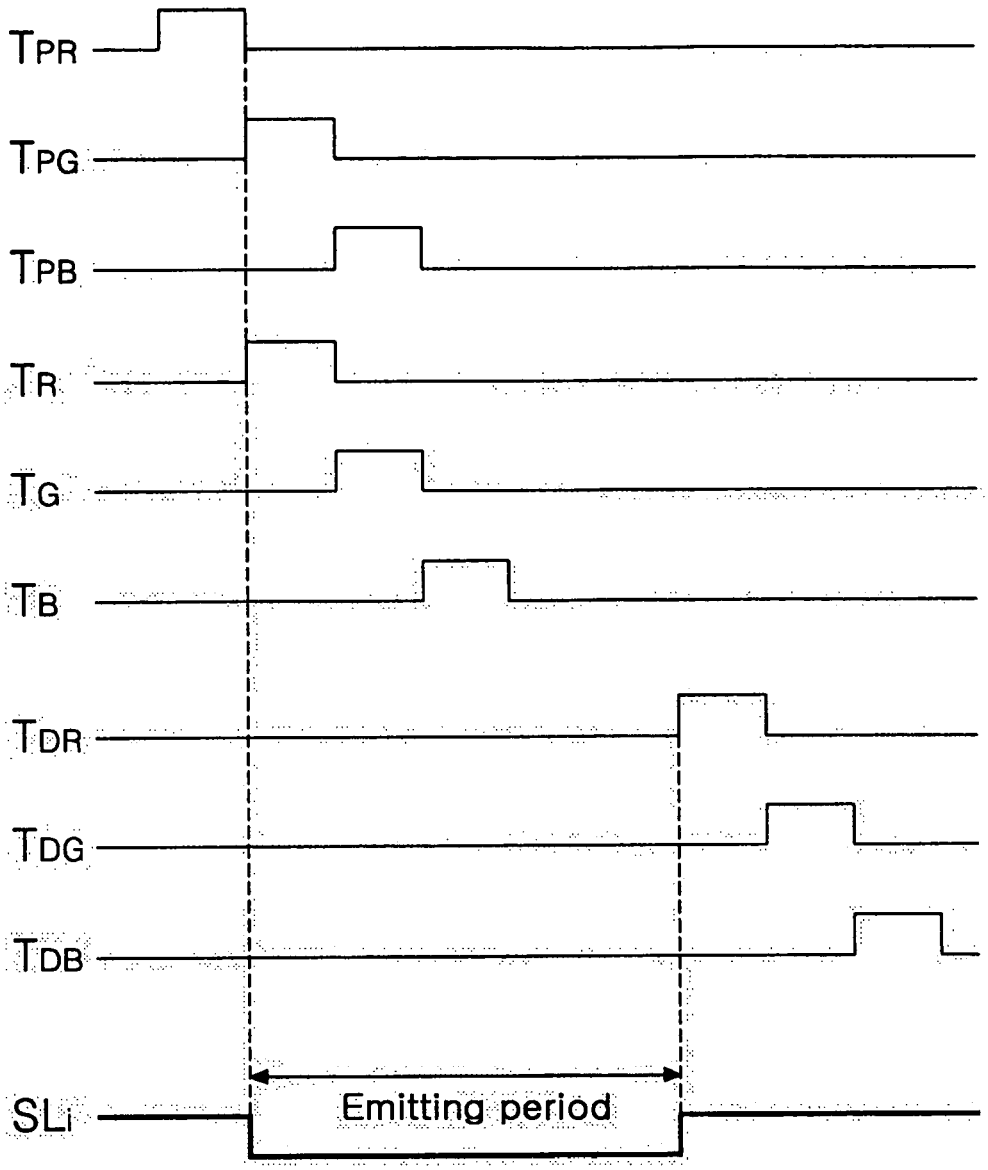
FIG. 8 is a timing diagram showing a signal sent to each switch of the driving circuit of FIG. 7.

FIG. 6 is a diagram of the organic electroluminescent device according to one embodiment of the present invention. FIG. 7 is a driving circuit of the organic electroluminescent device of FIG. 6. And, FIG. 8 is a timing diagram showing a signal sent to each switch of the driving circuit of FIG. 7.

In FIG. 6, the organic electroluminescent device according to one embodiment of the present invention includes a panel 120, a scan driving circuit 124, a data driving circuit 122, and a pre-charge driving circuit 132. Preferably, it further includes a discharge driving circuit 134.

Also, the organic electroluminescent device may further include data controller 126 controlling the data driving circuit 122, pre-charge controller 128 controlling the pre-charge driving circuit 132, and discharge controller 130 controlling the discharge driving circuit 134.

The panel 120 includes a plurality of pixels 110 formed on an area crossing over data lines (from DL1 to DLm) and scan lines (from SL1 to SLn).

The pixel 110 consists of red sub-pixel 110A, green sub-pixel 110B, and blue sub-pixel 110C.

The anode of the red, green and blue sub-pixels 110A, 110B and 110C is connected to the data lines (from DL1 to DLm), and the cathode is connected to the scan lines (from SL1 to SLn). The red, green and blue sub-pixels 110A, 110B and 110C emit light during low logic time of the scan signal (SCAN) applied to the scan lines (from SL1 to SLn) when the data current (Id) is applied to the data lines (from DL1 to DLm).

The scan driving circuit 124 applies scan signals to the scan lines (from SL1 to SLn).

Each of the scan signals has an emitting period having a low logic level and a non-emitting period having a high logic level. That is, the pixels 110 emit light during the low logic level, and do not emit light during the high logic level.

The data driving circuit 122 applies data current (Id) to the data lines (from DL1 to DLm), and the pre-charge driving circuit 132 applies pre-charge current (Ipd) to the data lines (from DL1 to DLm). The discharge driving circuit 134 discharges the data lines (from DL1 to DLm) charged by the data current (Id).

The pre-charge driving circuit 132 applies the pre-charge current (Ipd) to the data lines (from DL1 to DLm) of the red, green and blue sub-pixels 110A, 110B and 110C in order, according to control signal from the pre-charge controller 128, before the data current (Id) is applied thereto.

The discharge driving circuit 134 discharges the data lines (from DL1 to DLm) of the red, green and blue sub-pixels 110A, 110B and 110C charged by the data current (Id)

according to control signal from the discharge controller 130, before the pre-charge current (Ipd) is applied thereto.

Hereinafter, the driving circuit of the electroluminescent device of the present invention will be described in detail.

In FIG. 7, the data driving circuit 122 includes data current sources and data switches ($T_R$, $T_G$, $T_B$).

The data current sources applies the data current (Id) to the data lines (from DL1 to DLm) of the red, green and blue sub-pixels 110A, 110B and 110C.

The data switches ($T_R$, $T_G$, $T_B$) are turned on for applying the data current (Id) to the data lines (from DL1 to DLm) of the red, green and blue sub-pixels 110A, 110B and 110C in order.

The pre-charge driving circuit 132 includes pre-charge current sources and pre-charge switches ($T_{PR}$, $T_{PG}$, $T_{PB}$).

The pre-charge current sources applies the pre-charge current (Ipd) to the data lines (from DL1 to DLm) of the red, green and blue sub-pixels 110A, 110B and 110C.

The pre-charge switches ($T_{PR}$, $T_{PG}$, $T_{PB}$) are turned on for applying the pre-charge current (Ipd) to the data lines (from DL1 to DLm) of the red, green and blue sub-pixels 110A, 110B and 110C in order.

The discharge driving circuit 134 includes discharge switches ($T_{DR}$, $T_{DG}$, $T_{DB}$). The discharge switches ($T_{DR}$, $T_{DG}$, $T_{DB}$) are turned on for discharging the data lines (from DL1 to DLm) of the red, green and blue sub-pixels 110A, 110B and 110C charged by the data current (Id) to a ground power source (GND) in order.

The data switches ($T_R$, $T_G$, $T_B$) apply the data current (Id) to the data lines (from DL1 to DLm) of each of the red, green and blue sub-pixels 110A, 110B and 110C in order, according to switch on-off signal sent from the data controller 126 as shown in FIG. 8. The pre-charge switches ($T_{PR}$, $T_{PG}$, $T_{PB}$) apply the pre-charge current (Ipd) to the data lines (from DL1 to DLm) of each of the red, green and blue sub-pixels 110A, 110B and 110C in order, according to switch on-off signal sent from the pre-charge controller 128.

Also, the discharge switches ($T_{DR}$, $T_{DG}$, $T_{DB}$) discharge the data lines (from DL1 to DLm) of the red, green and blue sub-pixels 110A, 110B and 110C charged by the data current (Id) in order, according to switch on-off signal sent from the discharge controller 130.

Preferably, the discharge driving circuit 134 further includes zener diodes ($D_{ZR}$, $D_{ZG}$, $D_{ZB}$) between the ground power source (GND) and the discharge switches ($T_{DR}$, $T_{DG}$, $T_{DB}$). The zener diodes ($D_{ZR}$, $D_{ZG}$, $D_{ZB}$) discharge the data lines (from DL1 to DLm) by a voltage compensated from ground voltage. Thus, the organic electroluminescent device may decrease the consumption power by decreasing amplitude of discharged current.

Hereinafter, the driving method of the organic electroluminescent device according to one embodiment of the present invention will be described in detail.

Figure 9:
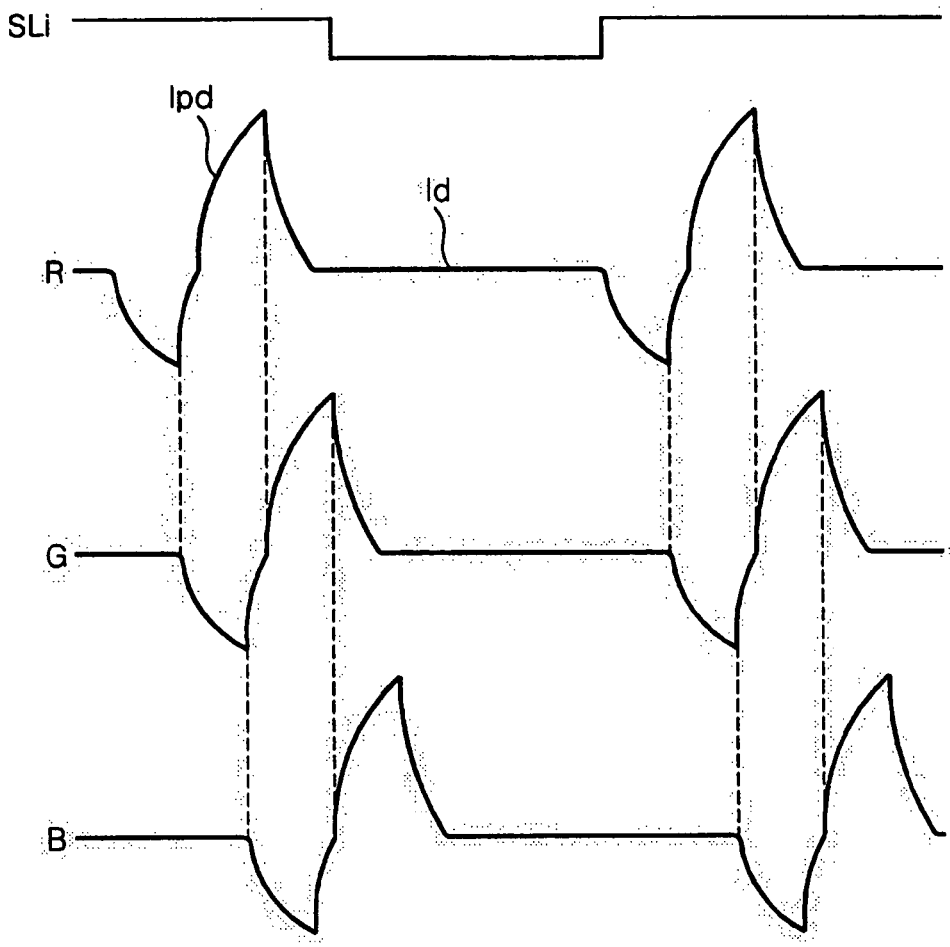
FIG. 9 is a diagram showing a data pulse applied to the organic electroluminescent device of FIG. 6.

FIG. 9 is a diagram showing a data pulse applying to the organic electroluminescent device of FIG. 6.

In FIG. 9, the pre-charge current (Ipd) is applied to the data lines (from DL1 to DLm) of the red sub-pixels 110A, after which the data current (Id) is applied thereto. Preferably, the pre-charge current (Ipd) is applied after the data current (Id) and the pre-charge current (Ipd) applied to the data lines (from DL1 to DLm) of the red sub-pixels 110A are discharged.

And, after the pre-charge current (Ipd) is applied to the data lines (from DL1 to DLm) of the red sub-pixels 110A, the pre-charge current (Ipd) is applied to the data lines (from DL1 to DLm) of the green and blue sub-pixels 110B and 110C in order. Then, the data current (Id) is applied thereto in order.

Preferably, after the data current (Id) and the pre-charge current (Ipd) applied to the data lines (from DL1 to DLm) of the green and blue sub-pixels 110B and 110C are discharged, the data lines (from DL1 to DLm) of the red sub-pixels 110A charged by the data current (Id) are discharged in order. If the data current (Id) and the pre-charge current (Ipd) applied to the data lines (from DL1 to DLm) of the green and blue sub-pixels 110B and 110C are discharged in order, the pre-charge current (Ipd) is applied to the data lines (from DL1 to DLm) of the green and blue sub-pixels 110B and 110C in order, and then the data current (Id) is applied thereto in order.

That is, the pre-charge current (Ipd) is applied to the data lines (from DL1 to DLm) of the red, green and blue sub-pixels 110A, 110B and 110C in order, and then the data current (Id) is applied thereto in order. And, the data lines (from DL1 to DLm) of the red, green and blue sub-pixels 110A, 110B and 110C charged by the data current (Id) are discharged in order.

In short, the organic electroluminescent device according to one embodiment of the present invention applies the pre-charge current (Ipd) to the data lines (from DL1 to DLm) of the red, green and blue sub-pixels 110A, 110B and 110C in order. Therefore, the organic electroluminescent device of the present invention can reliably receive voltage from the voltage source by preventing drop of the voltage.

Also, the load of the organic electroluminescent device to the discharge current can be reduced by discharging the data lines (from DL1 to DLm) of the red, green and blue sub-pixels 110A, 110B and 110C charged by the data current (Id) in order.

The organic electroluminescent device of the present invention emits light when the scan signal applied to the scan lines (SLi) has low logic level, not when the data current (Id) is applied to the data lines (from DL1 to DLm) of the red, green and blue sub-pixels 110A, 110B and 110C.

In FIG. 9, the emitting period is set as the period of time that the data current (Id) is applied to the data lines (from DL1 to DLm) of the red sub-pixels 110A. However, the emitting period may be set as the period of time that the data current (Id) is applied to the data lines (from DL1 to DLm) of the green or blue sub-pixels 110B and 110C.

That is, the organic electroluminescent device of the present invention can be operated as long as the data current (Id) and the pre-charge current (Ipd) are applied to each of the data lines (from DL1 to DLm) of the red, green and blue sub-pixels 110A, 110B and 110C in different time, and the data current (Id) and the pre-charge current (Ipd) are discharged in different time.

From the preferred embodiments for the present invention, it is noted that modifications and variations can be made by a person skilled in the art in light of the above teachings. Therefore, it should be understood that changes may be made for a particular embodiment of the present invention within the scope and spirit of the present invention outlined by the appended claims.

What is claimed is:

1. A circuit for driving an electroluminescent device having a plurality of unit pixels at crossing areas of data lines and scan lines, each unit pixel including red, green and blue sub-pixels connected to a same scan line, comprising:

a pre-charge driving circuit which applies pre-charge current to the data lines of each of the plurality of unit pixels connected to the same scan line prior to applying a data current to a corresponding unit pixel, the pre-charge current including a first pre-charge current for the red sub-pixels, a second pre-charge current for the green sub-pixels, and a third pre-charge current for the blue sub-pixels; and a data driving circuit which applies the data current to the pre-charged data lines, wherein the first pre-charge current is applied to all of the red sub-pixels of all of the unit pixels connected to the same scan line simultaneously during a first time period, then the second pre-charge current is applied to all of the green sub-pixels of all of the unit pixels connected to the same scan line simultaneously during a second time period after the first time period, and then the third pre-charge is applied to all of the blue sub-pixels of all of the unit pixels connected to the same scan line simultaneously during a third time period after the second time period, wherein the data current applied to the red sub-pixels is applied during the second time period, after the first time period, and is overlapped with the pre-charge current applied to the green sub-pixels, the data current applied to the green sub-pixels is applied during the third time period, after the second time period, and is overlapped with the pre-charge current applied to the blue sub-pixels, and the data current applied to the blue sub-pixels is applied after the third time period.

2. The circuit of claim 1, wherein the electroluminescent device is an organic device.

3. The circuit of claim 1, further including:

a discharge driving circuit which discharges the data lines charged by the data current.

4. The circuit of claim 1, wherein the data driving circuit includes:

data current sources which apply the data current; and first to third data switches which connect the data current sources to the data lines of the red, green, and blue sub-pixels.

5. The circuit of claim 1, wherein the pre-charge driving circuit includes:

pre-charge current sources which apply the pre-charge current; and first to third pre-charge switches which connect the pre-charge current sources to the data lines of the red, green, and blue sub-pixels.

6. The circuit of claim 3, wherein the discharge current circuit includes;

first to third discharge switches which connect the data lines of the red, green, and blue sub-pixels to a ground.

7. The circuit of claim 6, wherein the discharge driving circuit further including:

first to third Zener diodes which are connected between the data lines of the red, green, and blue sub-pixels and the ground.

8. A method of driving an electroluminescent device having a plurality of unit pixels at crossing areas of data lines and scan lines, each unit pixel including red, green and blue sub-pixels connected to a same scan line, comprising:

applying a first pre-charge current to data lines corresponding to all of the red sub-pixels of all of the unit pixels connected to the same scan line simultaneously during a first time period;

applying a second pre-charge current to data lines corresponding to all of the green sub-pixels of all of the unit pixels connected to the same scan line simultaneously during a second time period after the first time period;

applying a third pre-charge current to data lines corresponding to all of the blue sub-pixels of all of the unit pixels connected to the same scan line simultaneously during a third time period after the second time period; and applying a data current to the pre-charged data lines of the first to third sub-pixels, wherein the data current applied to the red sub-pixels is applied during the second time period, after the first time period, and is overlapped with the pre-charge current applied to the green sub-pixels, the data current applied to the green sub-pixels is applied during the third time period, after the second time period, and is overlapped with the pre-charge current applied to the blue sub-pixels, and the data current applied to the blue sub-pixels is applied after the third time period.

9. The method of claim 8, wherein the electroluminescent device is an organic device.

10. The method of claim 8, wherein the pre-charge current applied to the green sub-pixel is overlapped with the data current applied to the red sub-pixel, and the pre-charge current applied to the blue sub-pixel is overlapped with the data currents applied to the red and green sub-pixels.

11. The method of claim 8, wherein a section applying the pre-charge current to the red, green, and blue sub-pixels is not overlapped.

12. An electroluminescent device, comprising:

a plurality of scan lines in a first direction;

a plurality of data lines in a second direction different from the first direction;

a plurality of unit pixels including a corresponding scan line and a corresponding data line, each unit pixel including red, green and blue sub-pixels connected to a same scan line, a pre-charge driving circuit which applies pre-charge current to the data lines of each of the plurality of unit pixels connected to the same scan line prior to applying a data current to a corresponding unit pixel, the pre-charge current including a first pre-charge current for the red sub-pixels, a second pre-charge current for the green sub-pixels, and a third pre-charge current for the blue sub-pixels; and a data driving circuit which applies the data current to the pre-charged data lines, wherein the first pre-charge current is applied to all of the red sub-pixels of all of the unit pixels connected to the same scan line simultaneously during a first time period, then the second pre-charge current is applied to all of the green sub-pixels of all of the unit pixels connected to the same scan line simultaneously during a second time period after the first time period, and then the third pre-charge is applied to all of the blue sub-pixels of all of the unit pixels connected to the same scan line simultaneously during a third time period after the second time period, wherein the data current applied to the red sub-pixels is applied during the second time period, after the first time period, and is overlapped with the pre-charge current applied to the green sub-pixels, the data current applied to the green sub-pixels is applied during the third time period, after the second time period, and is overlapped with the pre-charge current applied to the blue sub-pixels, and the data current applied to the blue sub-pixels is applied after the third time period.

13. The device of claim 12, wherein the pre-charge current applied to the green sub-pixel is overlapped with the data current applied to the red sub-pixel, and the pre-charge current applied to the blue sub-pixel is overlapped with the data currents applied to the red and green sub-pixels.

14. The device of claim 12, wherein a section applying the pre-charge current to the red, green, and blue sub-pixels is not overlapped one another.

15. A method of driving an electroluminescent device having a plurality of unit pixels at crossing areas of data lines and scan lines, each unit pixel including red, green and blue sub-pixels connected to a same scan line, comprising:

applying a first pre-charge waveform to the data lines corresponding to all of the red sub-pixels of all of the unit pixels connected to the same scan line simultaneously during a first time period;

applying a second pre-charge waveform to the data lines corresponding to all of the green sub-pixels of all of the unit pixels connected to the same scan line simultaneously during a second time period after the first time period;

applying a third pre-charge waveform to the data lines corresponding to all of the blue sub-pixels of all of the unit pixels connected to the same scan line simultaneously during a third time period after the second time period, wherein the first to third pre-charge waveforms include a corresponding non-precharging period followed by a corresponding pre-charging period, wherein a starting time of the second pre-charge waveform is overlapped with an ending time of the first pre-charge waveform, and wherein a starting time of the third pre-charge waveform is overlapped with an ending time of the second pre-charge waveform, and wherein a data current applied to the red sub-pixels is applied during the second time period, after the first time period, and is overlapped with the pre-charge current applied to the green sub-pixels, a data current applied to the green sub-pixels is applied during the third time period, after the second time period, and is overlapped with the pre-charge current applied to the blue sub-pixels, and a data current applied to the blue sub-pixels is applied after the third time period.

16. The method of claim 15, wherein a starting time of the pre-charging period of the third pre-charge waveform is overlapped with the ending time of the second pre-charge waveform.

* * * * *